United States Patent [19]

Cavanagh

[11] 4,343,439

[45] Aug. 10, 1982

[54] NARROW FABRIC BLOCKER

[75] Inventor: Kenneth M. Cavanagh, Warwick, R.I.

[73] Assignee: Marshall & Williams Company, Providence, R.I.

[21] Appl. No.: 197,249

[22] Filed: Oct. 15, 1980

[51] Int. Cl.[3] ..... B65H 67/02; B65H 75/00

[52] U.S. Cl. ..... 242/41; 242/81

[58] Field of Search ..... 242/41, 81, 55, 67.1, 242/68, 68.3, 68.4, 84, 77, 78, 78.1, 47, 60, 62, 67, 18 R, 25 R, DIG. 2

[56] References Cited

U.S. PATENT DOCUMENTS

| | | | |
|---|---|---|---|
| 2,306,466 | 12/1942 | Patterson | 242/81 X |
| 2,829,845 | 4/1958 | Loop | 242/81 |
| 2,985,401 | 5/1961 | Gazet | 242/81 |
| 3,637,154 | 1/1972 | Northup | 242/81 X |
| 3,693,897 | 9/1972 | Davidson | 242/41 X |
| 3,704,839 | 12/1972 | Manoogian | 242/81 X |
| 4,007,884 | 2/1977 | Schippers et al. | 242/41 |
| 4,138,072 | 2/1979 | Aoyama et al. | 242/41 X |
| 4,211,375 | 7/1980 | Weiss et al. | 242/81 |

FOREIGN PATENT DOCUMENTS

| | | | |
|---|---|---|---|
| 907522 | 3/1954 | Fed. Rep. of Germany | 242/81 |

*Primary Examiner*—Stanley N. Gilreath

[57] ABSTRACT

An apparatus is illustrated for packaging narrow fabric such as webbing, belting, ribbon and the like into rolls or blocks for shipment wherein, a manually operated means which is normally out of engagement during a packaging operation may be urged from the hub side of the reel to dislodge the package for removal for doffing from the reel, and a power operated means is provided for moving a gripping flange into and out of packaging relation to the package mounting flange and hub.

2 Claims, 3 Drawing Figures

NARROW FABRIC BLOCKER

BACKGROUND OF THE INVENTION

Narrow fabric is presently packaged in a number of ways which include boxing by means of what is known as a festoona and by spooler upon the elongated spools upon which one often sees ribbon wound. A third means of packaging narrow fabrics includes blocking upon what is known as a narrow fabric blocker wherein the narrow fabric is wound about itself with selvages of the convolutions aligned about cardboard cores carried by a hub fixed to a mounting flange. The hub is driven from the power takeoff mechanism by suitable gearing or other power transmission means within a housing by a suitable motor.

In normal operations upon blockers, the fabric is doffed entirely manually by tugging at the sides of the package in an effort to dislodge the cardboard core upon which it is wound, from a hub on which the core is carried and restrained against rotation relative thereto, as by a pressed fit. This manual pulling action often results in the convolutions of the block sloughing off. A bearing has been used in the past to doff such packages, but such has not proved to be satisfactory due to the fact that the bearing is always by some means carried in sliding or other relatively rotatable engagement upon the drive mechanism during driving operation of the device. Manually operated means are normally employed for moving the opposed idler flange into package confining relationship for operation opposite the side of the package opposite the first mentioned hub carried flange.

Accordingly, it is an important object of this invention to provide a manually operable means for dislodging a block of narrow fabric for doffing from the blocker wherein the actuator mechanism is disengaged and there is no contact whatever as would cause wear between relatively rotating parts during a packaging operation.

Another important object of the invention is to provide power operated means for engaging a package positioning flange opposite the cardboard core upon which the block is formed.

The prior art includes United States Letters Pat. Nos. 4,007,884 and 4,138,072 which illustrate pushing members engaging the inboard end of a bobbin tube for doffing yarn packages from winders.

SUMMARY OF THE INVENTION

It has been found that a manually operable device for exerting force from externally of the reel to dislodge the package from the reel may be provided by utilizing a pivoted yoke for operating spaced spring biased plungers extending through the packaging reel for operating an ejector plate carried centrally about the hub of the reel adjacent the core of the package. A power operated means may be provided for automatically securing the package positioning flange in engagement with the package during a winding operation.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a blocker for narrow fabric and the like having a frame carrying a hub mounted flange on a motor driven shaft opposite an axially shiftable flange movable into and out of package positioning relation to the flange including an ejector plate A carried by the flange about the hub. Circumferentially spaced means B extend through the flange. Operator means C are carried by the radially spaced means. A pivoted yoke D is movable into operating relation to the operator means for urging the ejector plate through the operator means and the radially spaced means away from the flange engaging and ejecting a fully built block of narrow fabric packaged on the hub.

Figure 1:
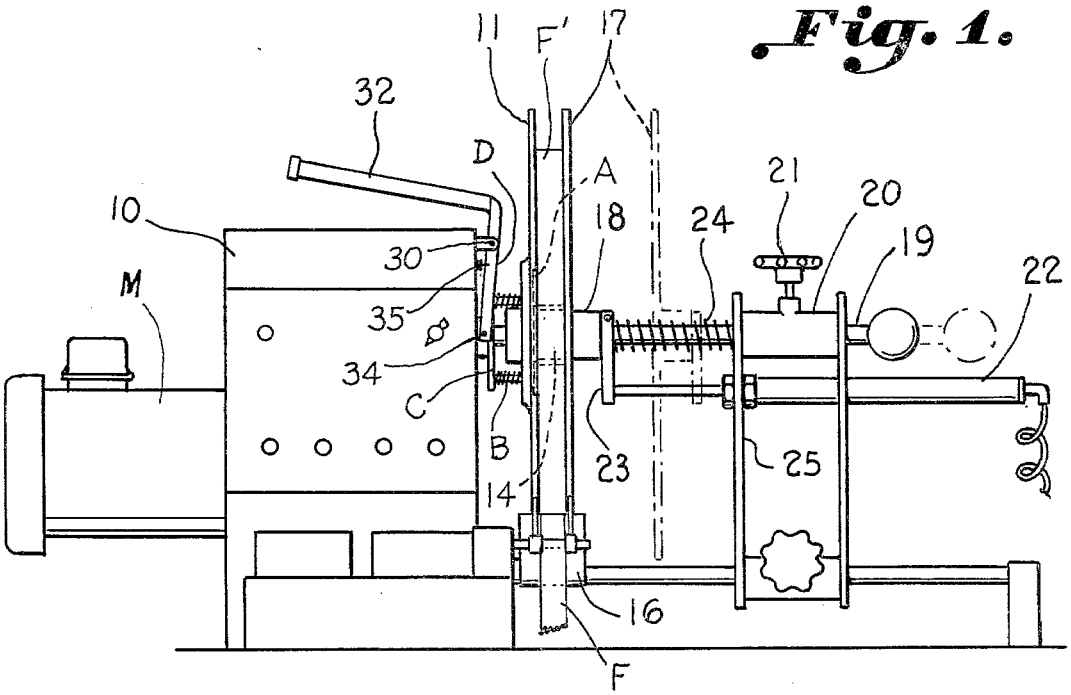
FIG. 1 is a schematic side elevation illustrating driving mechanism carried by a housing which serves as a mounting means for a hub flange which carries a cardboard core for winding narrow fabric into a package known as a block, together with power operated means for placing the package retaining hub in retaining position, constructed in accordance with the invention.
Figure 2:
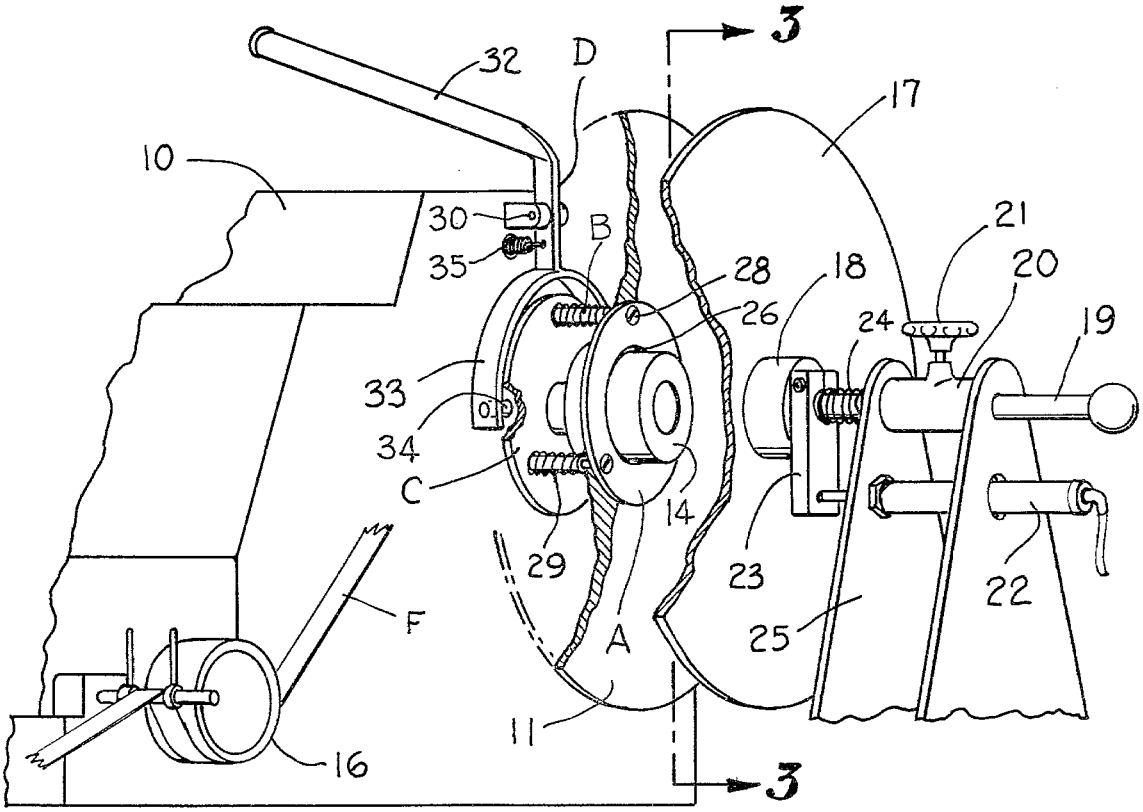
FIG. 2 is a perspective view looking toward the package and the flange carried core upon which the package is built.

Referring more particularly to FIG. 1, a blocker for narrow fabric is illustrated having a D.C. motor referred to in FIG. 1 at M. The motor M drives the hub carried flange through suitable powered transmission means contained within the upright housing 10. A flange 11 having a hub 12 is carried by a power takeoff shaft 13 which extends outwardly from the power transmission means carried within the housing 10 (see FIG. 3). The flange 11 carries a hub or chuck 14 for positioning a cardboard core 15 upon which the narrow fabric block F′ is wound or built. The narrow fabric F is shown being delivered to the machine through customary winding mechanism, shown as yardage counter roll 16. A package positioning flange 17 is mounted upon an idler bearing 18. A connecting shaft 19 is slidably carried within a sleeve 20 and may be fixed as by turning the wheel 21 which engages a threaded member (not shown) with the shaft. An air operated solenoid actuated cylinder 22 operates through an arm 23 to move the package positioning flange 17 to the left in FIG. 1 to confine the block of narrow fabric F′. Preferably, a coil tension spring 24 is carried between the arm 23 and the bracket 25 supporting the sleeve 20 which automatically causes the package positioning flange 17 to be moved to the right in package releasing position. Thus, the shaft 19 moves with the flange 17 against the force of the spring 24 by forceful urging of the cylinder 22 through the arm 23. The arm 23 is connected to the shaft 19 which carries the bearing 18. The tension placed in the spring causes return of the shaft 19 to the right in FIG. 1 when the shaft 19 is released by turning the wheel 21.

Figure 3:
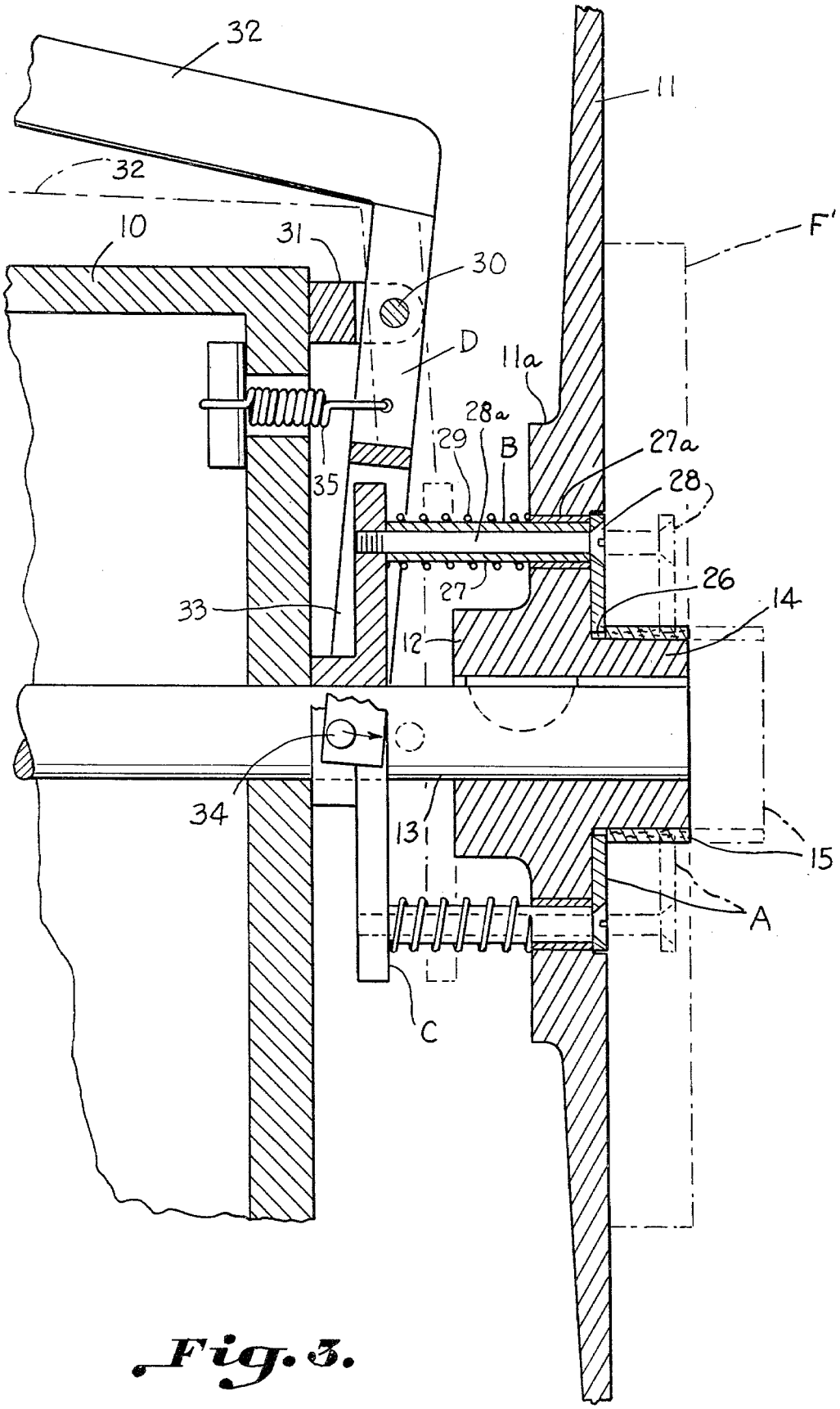
FIG. 3 is an enlarged transverse sectional elevation taken on the line 3—3 in FIG. 2.

Referring more particularly to FIG. 3, it will be observed that an annular ejection plate A has an opening 26 in the central portion thereof which permits its passage over the hub or chuck 14 when dislodging the package of fabric F. Engagement may be had by the ejection plate A with the cardboard core 15 or with the adjacent central portion of the fabric block itself. Circumferentially spaced about the ejector plate A, a plurality of circumferentially spaced means B are carried which extend through the flange 11. The means B include a sleeve 27 which is fixed between the head of a countersunk screw head 28 and the annular operator means C. The tapered screw head 28 which carries the threadable shank portion 28*a* serves to center the sleeve 27. The sleeve 27 is carried for sliding within a suitable bushing 27*a*. The screw shank 28*a* is threadably received within the operator C and a coil spring 29 is carried between the operator C and an enlarged rim 11*a* of the flange 11.

The yoke D is pivoted as at 30 upon a bracket 31 extending from the housing 10. An operating handle 32 forms a part of the yoke and a depending bifurcated portion thereof 33 carries inwardly extending operator members 34 for engaging the annular operator ring C for urging the ejector ring A into operation to remove the package core 15 and the package carried thereby from the chuck 14. The coil spring 29 returns the operator to the position illustrated in FIG. 3 and the ejector ring or plate carried thereby into depressed position for permitting a core and package to be subsequently built upon the chuck 14. A return coil spring 35 is connected between the depending portion 33 of the yoke and the housing for returning the operator members 34 carried by the yoke out of any engagement whatever with the operating means C during winding or package building.

After the package building operation which takes about fifteen seconds, the tape on the free end is pinned or otherwise secured after which the package may be doffed as described above. Since the block or cheese ejection mechanism is entirely out of engagement during building of the package, there is no excess wear and a simple structure is then provided for effective operation. The yoke as described is similar to the throw out mechanism often used to actuate clutch mechanisms and is very easy to operate.

While a preferred embodiment of the invention has been described using specific terms, such description is for illustrative purposes only, and it is to be understood that changes and variations may be made without departing from the spirit or scope of the following claims.

What is claimed is:

1. A blocker for narrow fabric and the like having a stationary frame carrying a hub carried flange on a motor driven shaft opposite an axially shiftable flange movable into and out of package positioning relation to said hub carried flange comprising:

an ejector plate carried by said flange about said hub;

circumferentially spaced means extending through said flange connected to said ejector plate;

operator means carried by said circumferentially spaced means; and a yoke pivotally mounted on said stationary frame movable into operating relation to said operator means for urging said ejector plate, through said operator means and said circumferentially spaced means, away from said flange and for engaging and ejecting a block of narrow fabric packaged on said hub.

2. The structure set forth in claim 1 including a spring means normally biasing said yoke out of operating relation to said operator means.

* * * * *